US005816741A

United States Patent [19]

Troppman, III

[11] Patent Number: 5,816,741

[45] Date of Patent: Oct. 6, 1998

[54] REMOTE CONTROL FOR WALK-BEHIND COMPACTOR

[75] Inventor: G. Louis Troppman, III, Maugansville, Md.

[73] Assignee: Ingersoll-Rand Company, Woodcliff Lake, N.J.

[21] Appl. No.: 834,778

[22] Filed: Apr. 3, 1997

[51] Int. Cl.[6] ..... E01C 19/28

[52] U.S. Cl. ..... 404/117; 404/127; 180/315; 180/334

[58] Field of Search ..... 404/121, 122, 404/127, 128, 117; 180/315, 326, 333, 334

[56] References Cited

U.S. PATENT DOCUMENTS 3,814,531 6/1974 Carnahan et al. ..... 404/117

4,069,881 1/1978 Shiber ..... 180/334

5,042,314 8/1991 Rytter et al. ..... 180/333 X

*Primary Examiner*—James Lisehora

*Attorney, Agent, or Firm*—John J. Selko

[57] ABSTRACT

A hand-held, portable control device for a walk-behind mobile compactor includes a control box for generating a plurality of electrical control signals. A handle on the control box is adapted to be grasped by a single hand of an operator, without requiring an operator's thumb to support the control box. The handle is adapted to position an operator's thumb adjacent to the control box so as to permit the thumb to move freely in all directions. A flexible cable connects the control box to the compactor. Switches for activating electrical signals from the control box are positioned within a proximity of an operator's thumb, when the handle is grasped by an operator, the switches being movable among a plurality of activation positions in response to movement of an operator's thumb.

5 Claims, 3 Drawing Sheets

REMOTE CONTROL FOR WALK-BEHIND COMPACTOR

BACKGROUND OF THE INVENTION

This invention relates generally to walk-behind trench compactors, and more particularly to hand-held, portable control devices for use with such compactors. Prior art portable control devices require manipulation by both hands of the operator. This condition requires some sort of belt or platform support device, and additionally tires the operator's arms because the arms must be held up over the control device.

The foregoing illustrates limitations known to exist in present trench compactor control devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a hand-held, portable control device for use with a walk-behind mobile compactor vehicle, the compactor 1 carrying a plurality of control circuits for performing a function selected from the group comprising travel direction, vibration on/off and emergency stop, the control device comprising: means in a control box housing, for generating an electrical control signal; handle means on said housing adapted to be grasped by a single hand of an operator without requiring an operator's thumb to support the box, the handle adapted to position an operator's thumb adjacent to said housing to permit said thumb to move freely in all directions; flexible cable means for connecting said control device to a mobile compactor compactor 1 for powering said control device and for thereafter transmitting a control signal to a preselected control circuit of a compactor compactor 1; and switch means on said housing adjacent to said handle means for activating said electrical-signal generating means, said switch means positioned within a proximity of an operator's thumb when said handle is grasped by an operator, said switch means movable among a plurality of activation positions in response to movement of an operator's thumb.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
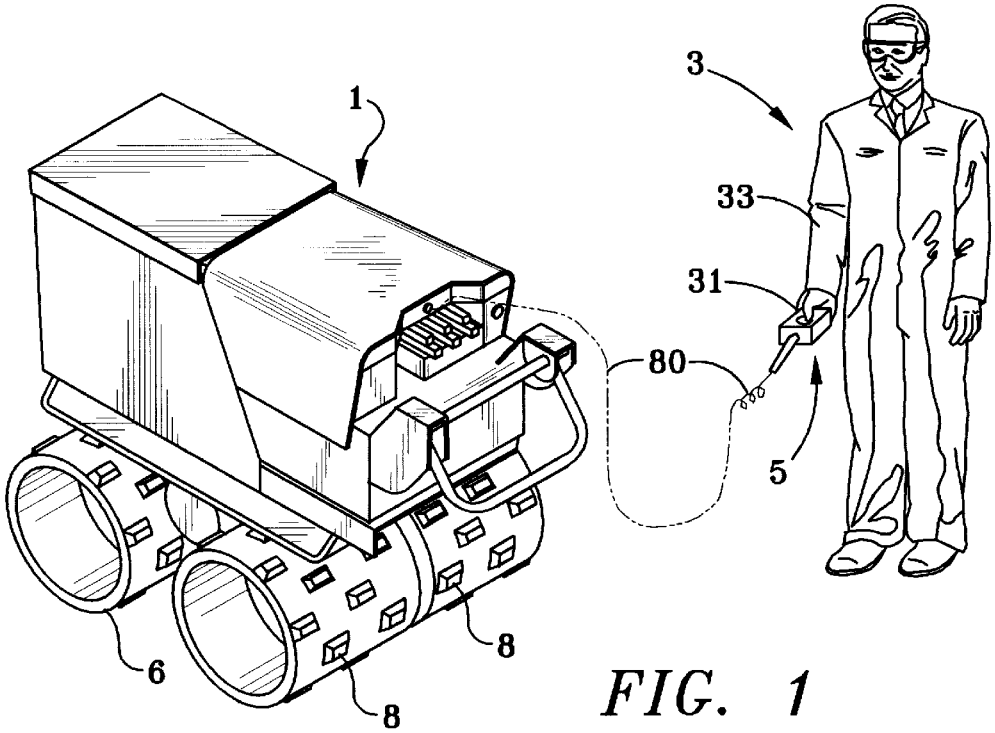
FIG. 1 is a schematic pictorial rendition of the control device of this invention being used by an operator with a trench compactor.
Figure 2:
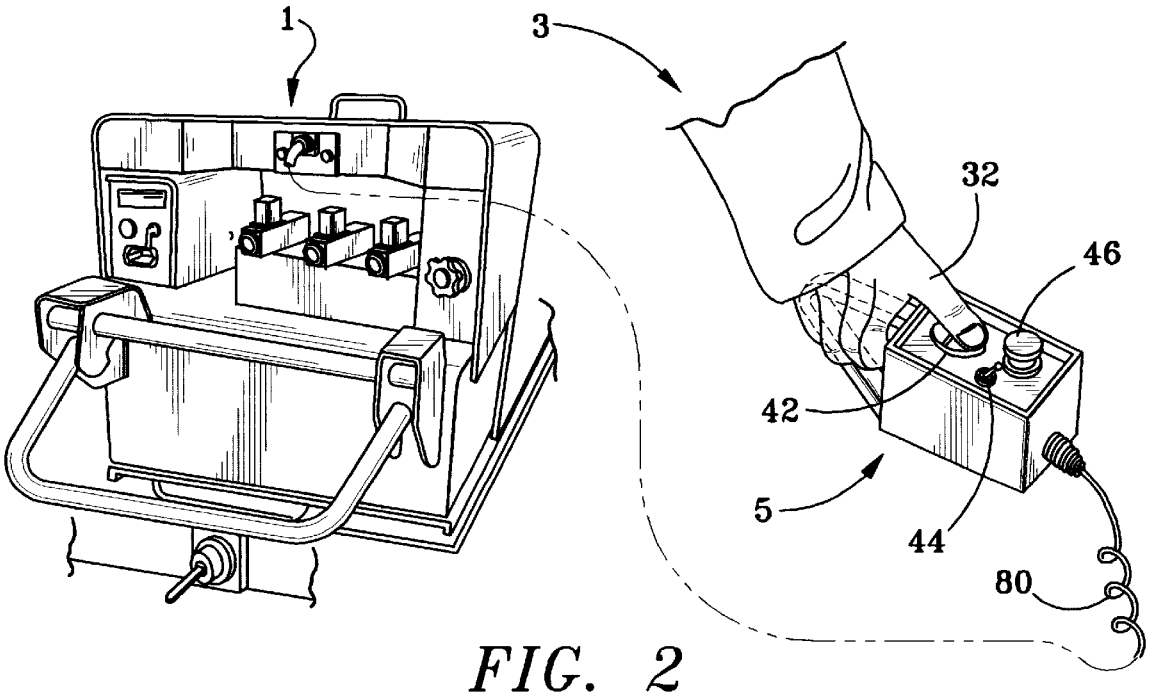
FIG. 2 is an expanded pictorial rendition showing the device of this invention connected to a trench compactor and held by an operator.

Now referring to FIGS. 1 and 2, a mobile trench compactor 1 of conventional design is shown being operated by an operator 3 using the control device 5 of the invention. As is well known, the compactor 1 is of the skid steer type that is movable from a stop position in either a forward or reverse direction and is capable of turning left and right. The compactor 1 is capable of providing vibratory impacts to the material being compacted. As is conventional, compactor 1 is driven by hydraulic motors (not shown) that rotate two front drums 6 and two rear drums 8 (one front drum 6 not being visible in the Figure). The compactor 1 carries hydraulic and electrical circuits, pumps and motors to provide the above described functions. FIGS. 1 and 2 show the operator 3 using a portable remote control device 5 of the invention.

Figure 4:
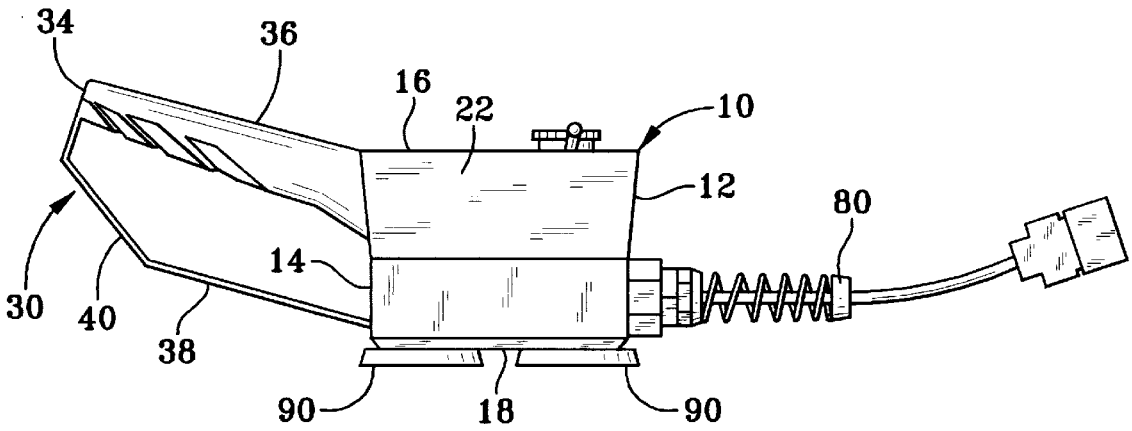
FIG. 4 is a side elevational view of the control device of the invention.
Figure 5:
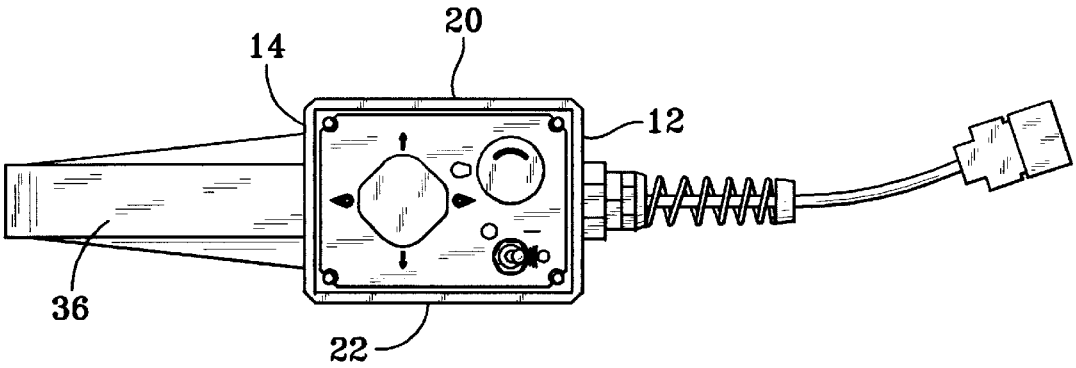
FIG. 5 is a top plan view of the control device of the invention.
Figure 6:
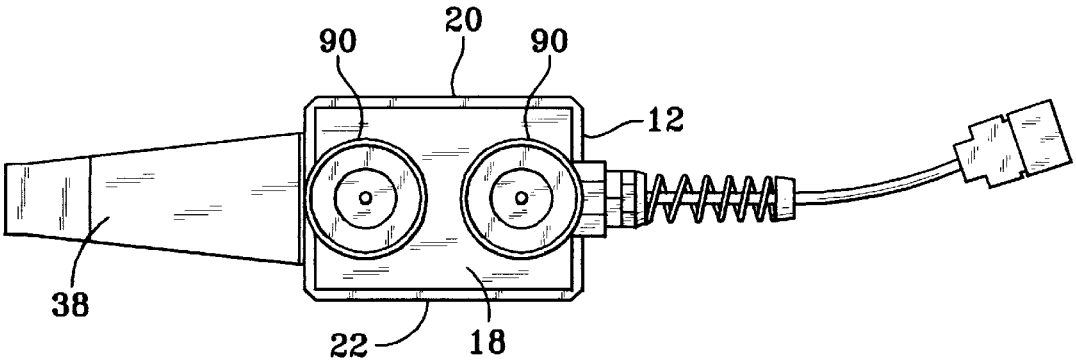
FIG. 6 is a bottom plan view of the control device of the invention.

Now referring to FIGS. 4–6, the control device 5 is shown to include a control box housing 10, preferably rectangular or cubic in form, having front, rear, top, bottom, left and right side walls, 12, 14, 16, 18, 20 and 22, respectively. The purpose of the control box 10 is to generate low voltage, low amperage electrical control signals that active the various electrical and hydraulic control circuits on the compactor 1, to perform any function selected by the operator. The control box 10 is powered by a 12 volt, DC battery carried on the compactor 1. The characteristics of the control signal's electrical voltage or amperage are well known, and in use for prior art control devices used with compactors of the type described herein. Any conventional signal generating means will do, but I prefer a signal generating control box with the model designation DA-00B-D, provided by Hydro Electronic Devices, Inc., 147 North Rural Street, P.O.Box 218, Hartford, Wis. 50327.

Handle 30 is connected to housing 10 and is adapted to be grasped by a single hand 31 of operator 3, without requiring a thumb 32 to support the device 5. Handle 30 is adapted to position the operator's thumb 32 adjacent to housing 10, while permitting thumb 32 to move freely universally, that is, in all directions. Handle 30 has an upper attachment member 34 connected at one end to rear wall 14 of housing 10. Upper attachment member 34 forms a gripping member 36 for operator's hand 31. The shape of gripping member 36 can be ergonomically shaped for ease of use, and can be additionally covered with an elastomeric material, such as rubber, for shock absorbance. Attachment member 34 extends away from housing 10, at an upward angle with respect to top wall 16, to reverse into a lower attachment member 38 connected to rear wall 14 of housing 10, thereby forming a closed loop that provides rear portion connecting upper and lower members 36, 38 in an intermediate support member 40 that pulls upon, and supports, hand 31 of operator 3, when the compactor 1 moves forward. Also, the control device 5 can be held and operated by an operator 3 with an arm 33 extending straight down, in a natural position, greatly improving operator comfort.

Figure 3:
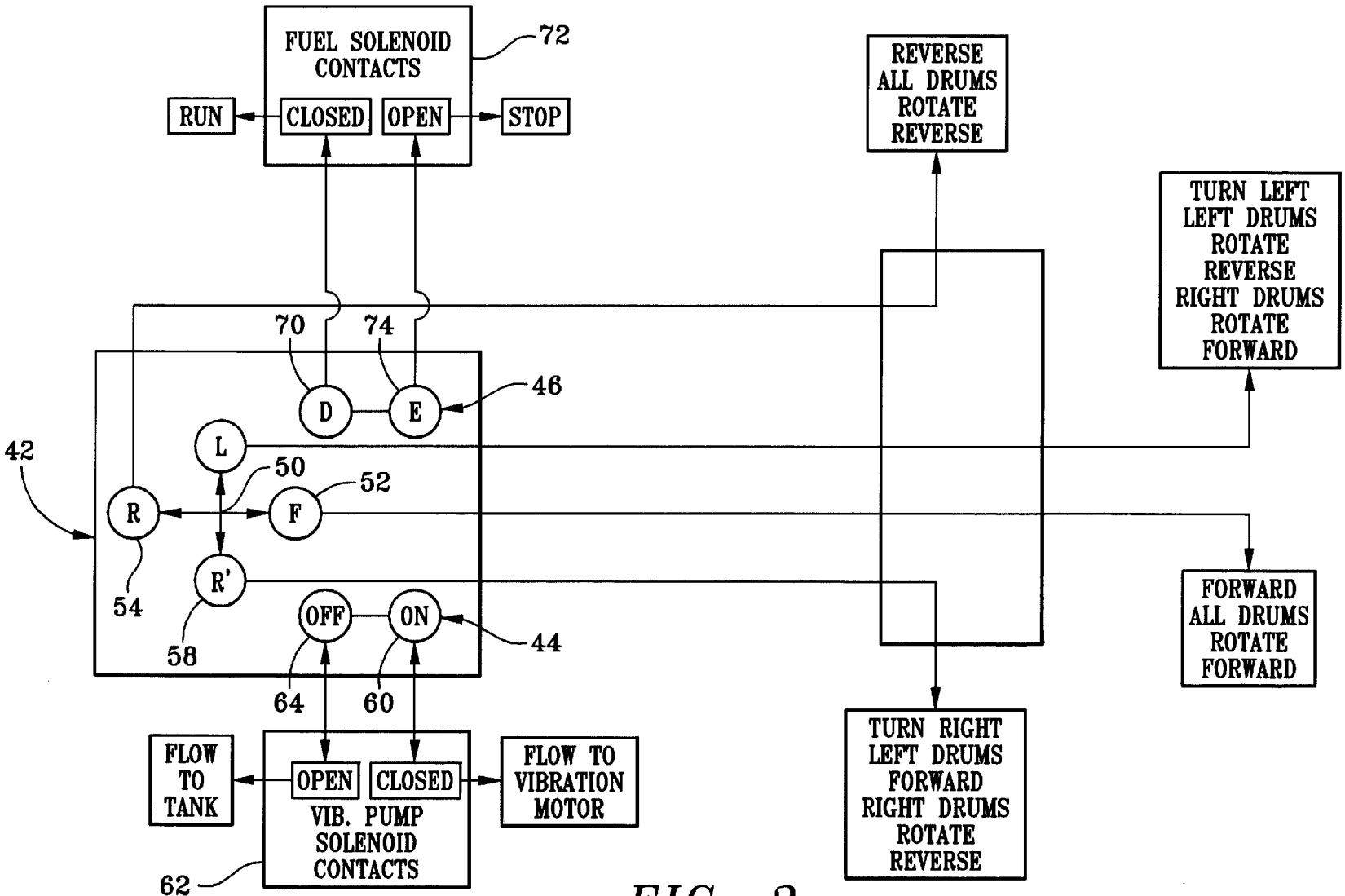
FIG. 3 is a schematic flow diagram showing the connections of the control device to the functions performed by a trench compactor.

Referring to FIGS. 1–3, the switch means of the invention will described. Mounted on top wall 16 of housing 10 are first switch 42, second switch 44 and third switch 46. All three switches are positioned adjacent handle 30 within a proximity of thumb 32, when handle 30 is grasped by the operator 3. All three switches can be operated by thumb 32.

Now referring to FIG. 3, first switch controls the electrical control signal that interacts with the electrical and hydraulic control circuits on the compactor 1 that control the travel function. First switch 42 is a normally open switch that can be moved from its normally open position 50 into any one of four activation positions by thumb 32. When switch 32 is normally open, the control circuits on the compactor 1 cause it to be in the stop position. With Switch 32 moved to the F position 52, all drums 6,8 move forward, causing the compactor 1 to move forward. With switch 32 moved to the R position 54, all drums 6,8 rotate in reverse, causing the compactor 1 to move in reverse. With the switch 32 moved to the L position 56, the left front and rear drums 6, 8 rotate in reverse, and the right front and rear drums 6,8 rotate in the forward direction, causing the compactor 1 to turn left. With the switch 32 moved to the R' position 58, the left front and rear drums 6,8 rotate forward, and the right front and rear drums 6,8 rotate in the reverse direction, causing the compactor 1 to turn right. This steering operation is known as skid steering.

Second switch 44 controls the electrical control signal that interacts with the electrical and hydraulic control circuits on the compactor 1 that control the vibration function. With switch 44 moved to the ON position 60, vibration circuit solenoid 62 on the compactor 1 is closed, causing hydraulic fluid to flow to the vibration motor, starting the vibration function, as is well known. With switch 44 moved to the OFF position 64, vibration circuit solenoid 62 is opened, causing hydraulic fluid to flow to the tank, stopping the vibration function, as is well known. Switch 44 can be a toggle switch or its equivalent.

Third switch 46 controls the electrical control signal that interacts with the electrical and hydraulic control circuits on the compactor 1 that control an emergency stop function. With switch 46 in the D position 70, fuel circuit solenoid 72 on the compactor 1 is closed, permitting fuel to flow to the compactor 1 motor (not shown) thereby powering compactor 1. With switch 46 moved the E position 74, fuel circuit solenoid 72 is opened causing fuel flow to stop, stopping the compactor 1. Third switch 46, being an emergency stop switch, is normally in the D position 70. Switch 46 is depressed to move it from the D position 70 to the E position 74, and additionally, means for locking the switch in the E position 74 can be provided, as is well known.

Permanent magnets 90 are attached to bottom wall 18 of housing 10, whereby the device 5 can be affixed to a metal frame of the compactor, for shipping and storage.

A flexible cable 80 is removably detached at one end to control device 5 and at the other end to compactor 1, to power the device 5 with a battery (not shown) carried by the compactor 5, and to transmit control signals to the compactor 1. The flexible control cable 80 is elastically extendable in length. Control cable is a multi-wire cable, preferably of the eight-pronged type, to provide sufficient separate circuits for transmitting a control signal to the compactor for each function being controlled. As is well known, such cables include multiple electrical transmission elements surrounded by layers of strengthening material, all covered in an abrasion resistant jacket.

The control device described herein is suitable for use with a Walk Behind Trench Compactor, Model FX-130, supplied by Ingersoll-Rand Company, 312 Ingersoll Drive, Shippensburg, Pa. 17257. While this device is described for use with a mobile compactor, it would be equivalent to use it to control any mobile vehicle capable of remote control by a hand-held, portable control device.

Having described the invention, what is claimed is:

1. A hand-held, portable control device for use with a walk-behind mobile compactor, the compactor 1 carrying a plurality of control circuits for performing a function selected from the group including travel direction, vibration on/off and emergency stop, the control device comprising:

(a) means in a control box housing, for generating a plurality of electrical control signals;

(b) handle means on said housing adapted to be grasped by a single hand of an operator, without requiring an operator's thumb to support said box, said handle means adapted to position an operator's thumb adjacent to said housing to permit said thumb to move freely in all directions;

(c) flexible cable means for connecting said control device to a mobile compactor for powering said control device and for thereafter transmitting a control signal to a preselected control circuit of said compactor; and (d) switch means on said housing adjacent to said handle means for activating said electrical signal generating means, said switch means positioned within a proximity of an operator's thumb when said handle is grasped by an operator, said switch means movable among a plurality of activation positions in response to movement of an operator's thumb.

2. The control device of claim 1 wherein said switch means comprises:

(a) a first switch movable between a plurality of activation positions, for activating a first signal for controlling a compactor movement function including a stop, a forward, a reverse, a right turn and a left turn function;

(b) a second switch movable between an on and off activation position, for activating a second signal for starting and stopping a compactor vibration function; and (c) a third switch movable between an on and off activation position, for activating a third signal for a compactor emergency stop function.

3. The control device of claim 2 wherein said first switch is a normally open switch.

4. The control device of claim 3 wherein said handle means has an upper attachment member connected at one end to said housing, forming a gripping portion, said upper attachment member extending away from said housing to reverse into a lower attachment member connected to said housing, said handle forming a closed loop to provide a rear member connecting said upper and lower attachment members in an intermediate support member that pulls upon, and supports, an operator's hand, when said compactor moves forward.

5. The control device of claim 4 wherein said gripping portion is covered with an elastomeric shock absorbing material.

* * * * *